US008371387B2

(12) United States Patent
Blair et al.

(10) Patent No.: US 8,371,387 B2
(45) Date of Patent: Feb. 12, 2013

(54) METHODS AND APPARATUS FOR MANIPULATING AND DRIVING CASING

(75) Inventors: Steven G. Blair, Tomball, TX (US); Brent J. Fendley, Cypress, TX (US); Adam Richard Williams, Conroe, TX (US); John G. Evans, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 13/360,424

(22) Filed: Jan. 27, 2012

(65) Prior Publication Data

US 2012/0125632 A1 May 24, 2012

Related U.S. Application Data

(62) Division of application No. 12/869,479, filed on Aug. 26, 2010.

(60) Provisional application No. 61/237,572, filed on Aug. 27, 2009.

(51) Int. Cl.
*E21B 19/00* (2006.01)
*E21B 19/16* (2006.01)
*E21B 19/18* (2006.01)

(52) U.S. Cl. ..... 166/380; 166/77.51; 166/85.1

(58) Field of Classification Search ..... 166/120, 166/207, 380, 387, 98, 77.51, 78.1, 117.7
See application file for complete search history.

(56) References Cited

U.S. PATENT DOCUMENTS

| | | | |
|---|---|---|---|
| 2,671,514 | A | 3/1954 | Haines |
| 3,283,824 | A | 11/1966 | Hoffman et al. |
| 3,412,800 | A | 11/1968 | Kesling, III |
| 3,727,967 | A | 4/1973 | Anastasiu et al. |
| 5,045,832 | A | 9/1991 | Tam |
| 5,265,937 | A | 11/1993 | Allen |
| 5,623,991 | A | 4/1997 | Jani |
| 5,771,970 | A | 6/1998 | Jani |
| 5,971,079 | A | 10/1999 | Mullins |
| 6,062,309 | A | 5/2000 | Gosse |
| 6,155,346 | A | 12/2000 | Aldridge |
| 6,199,641 | B1 | 3/2001 | Downie et al. |
| 6,227,306 | B1 | 5/2001 | Downie et al. |
| 6,309,002 | B1 | 10/2001 | Bouligny |

(Continued)

FOREIGN PATENT DOCUMENTS

| | | |
|---|---|---|
| JP | 09060468 | 3/1997 |
| JP | 2009018214 | 1/2009 |

(Continued)

OTHER PUBLICATIONS

Tesco, Casing Drive System, Bulletin 41000e, www.tescocorp.com, Jun. 2005, 4 pages.

(Continued)

*Primary Examiner* — Daniel P Stephenson
*Assistant Examiner* — Michael Wills, III
(74) *Attorney, Agent, or Firm* — Steve Rosenblatt

(57) ABSTRACT

An apparatus and methods for manipulating and driving casing. The apparatus includes mechanically responsive elements for gripping an interior of a casing joint, and hydraulically responsive elements for gripping an interior of the casing joint responsive to pressure of drilling fluid flowing through the apparatus. One method comprises manipulating a casing joint by mechanically gripping an interior thereof, hydraulically gripping the interior of the casing joint responsive to drilling fluid pressure, and rotating the casing joint. Another method comprises driving casing by applying weight and torque thereto through engagement with an interior thereof.

10 Claims, 3 Drawing Sheets

U.S. PATENT DOCUMENTS 6,311,792 B1 11/2001 Scott et al.
6,318,459 B1 11/2001 Wright et al.
6,536,520 B1 3/2003 Snider et al.
6,550,540 B2 4/2003 Trent
6,688,394 B1 2/2004 Ayling
6,688,398 B2 2/2004 Pietras
6,705,413 B1 3/2004 Tessari
6,725,938 B1 4/2004 Pietras
6,732,822 B2 * 5/2004 Slack et al. ..... 175/423
6,742,584 B1 6/2004 Appleton
7,021,374 B2 4/2006 Pietras
7,021,382 B2 4/2006 Angman et al.
7,044,241 B2 5/2006 Angman
7,077,205 B2 7/2006 Eddison
7,107,875 B2 * 9/2006 Haugen et al. ..... 81/57.15
7,117,957 B2 10/2006 Metcalfe et al.
7,121,350 B2 10/2006 Aldridge et al.
7,137,454 B2 11/2006 Pietras
7,140,443 B2 11/2006 Beierbach et al.
7,140,445 B2 11/2006 Shahin et al.
7,165,609 B2 1/2007 Slack et al.
7,191,840 B2 3/2007 Pietras et al.
7,219,744 B2 5/2007 Pietras
7,325,610 B2 2/2008 Giroux et al.
7,334,650 B2 2/2008 Giroux et al.
7,360,594 B2 * 4/2008 Giroux et al. ..... 166/242.6
7,370,707 B2 5/2008 McDaniel et al.
7,377,324 B2 * 5/2008 Beierbach et al. ..... 166/380
7,475,742 B2 1/2009 Angman et al.
7,513,300 B2 4/2009 Pietras et al.
7,624,820 B2 12/2009 Angman et al.
7,647,990 B2 1/2010 Tessari et al.
7,654,325 B2 2/2010 Giroux et al.
7,654,334 B2 2/2010 Manson
7,673,675 B2 3/2010 Carr et al.
7,681,649 B2 3/2010 Cerovsek
7,694,730 B2 4/2010 Angman
7,712,523 B2 5/2010 Snider et al.
7,757,754 B2 7/2010 McKay
7,770,635 B2 8/2010 Angman
7,784,551 B2 * 8/2010 Angman et al. ..... 166/382
7,874,352 B2 1/2011 Odell et al.
7,896,111 B2 3/2011 Slack
7,909,120 B2 3/2011 Slack
2002/0170720 A1 11/2002 Haugen
2004/0216892 A1 11/2004 Giroux et al.
2005/0000691 A1 1/2005 Giroux et al.
2005/0269105 A1 12/2005 Pietras
2007/0074876 A1 * 4/2007 Pietras ..... 166/379
2007/0131416 A1 6/2007 Odell et al.
2007/0193751 A1 * 8/2007 Pietras et al. ..... 166/380
2008/0083540 A1 * 4/2008 Haugen ..... 166/380
2008/0210439 A1 9/2008 Angman et al.
2008/0302525 A1 * 12/2008 Beierbach et al. ..... 166/85.1
2009/0101332 A1 4/2009 Shahin et al.
2009/0120649 A1 5/2009 Cerovsek
2009/0126936 A1 5/2009 Begley et al.
2009/0126941 A1 5/2009 Laitolais, Jr. et al.
2009/0136326 A1 5/2009 Angman
2009/0242192 A1 10/2009 Jensen et al.
2009/0272543 A1 11/2009 Bouligny et al.
2009/0314496 A1 12/2009 Begnaud et al.
2009/0321086 A1 12/2009 Zimmermann
2010/0139978 A9 6/2010 Giroux et al.
2010/0155052 A1 6/2010 Manson

FOREIGN PATENT DOCUMENTS

WO 2007019594 2/2007

OTHER PUBLICATIONS

International Search Report for International Application No. PCT/US2010/046844 mailed Apr. 15, 2011, 10 pages.
International Written Opinion for International Application No. PCT/US2010/046844 mailed Apr. 15, 2011, 4 pages.
Baker Hughes Incorporated, Technical Unit 4614, Type D Casing Spear, Product Family No. H12009, Oct. 2010, 2 pages.
Baker Hughes Incorporated, Technical Unit 4607, Type B Casing Spear, Product Family No. H12609, Nov. 2010, 2 pages.
Baker Hughes Incorporated, Technical Unit 4160, Model B-2 and B-3 Tubing Anchor Catcher, Product Family Nos. H69803 and H69804, Oct. 2003, 3 pages.

* cited by examiner

METHODS AND APPARATUS FOR MANIPULATING AND DRIVING CASING

CROSS-REFERENCE TO RELATED APPLICATION

This application is a divisional of U.S. patent application Ser. No. 12/869,479 filed on Aug. 26, 2010, which claims the benefit of U.S. Provisional Patent Application No. 61/237,572 entitled "METHODS AND APPARATUS FOR MANIPULATING AND DRIVING CASING," filed Aug. 27, 2009, the disclosure of which is incorporated herein in its entirety by this reference.

TECHNICAL FIELD

Embodiments of the present invention relate to manipulating casing for subterranean well bores. More particularly, embodiments of the present invention relate to methods and apparatus for gripping and rotating casing by the interior thereof from the earth's surface, which methods and apparatus may be employed to drill or ream with casing.

BACKGROUND

It is known in the art of subterranean drilling to use a so-called "top drive" to connect a section, also known as a "joint," of well bore casing above a drilling rig floor to the upper end of a casing string substantially disposed in the well bore. Such casing strings, commonly termed "surface casing," may be set into the well bore as much as 3,000 feet (914.4 meters), and typically about 1,500 feet (457.2 meters), from the surface.

Examples of methods and apparatus for making casing joint connections to a casing string are disclosed in U.S. Pat. Nos. 6,742,584 and 7,137,454, the disclosure of each of which patents is incorporated herein by this reference.

It is known in the art of subterranean drilling to drill and ream with casing, using a drilling or reaming shoe including a cutting structure thereon to drill a well bore, or to ream an existing well bore to a larger diameter, to remove irregularities in the well bore, or both. It would be highly desirable for the subterranean drilling industry to employ a top drive to apply weight on the casing in combination with casing rotation to drill or ream with casing using a drilling or reaming device at the distal end of the casing string.

BRIEF SUMMARY

In one embodiment, the present invention comprises a casing assembly having a longitudinal passage therethrough in communication with a plurality of circumferentially spaced, radially movable pistons and extending to at least one outlet of the lower end of the assembly, a plurality of selectively mechanically actuable, radially movable slips, a plurality of spring-biased friction blocks longitudinally spaced from the slips, a downward-facing packer cup positioned between the slips and the at least one outlet, and a tapered stabilizer guide below the downward-facing packer cup.

In another embodiment, the present invention comprises a method of manipulating casing comprising inserting an assembly into an upper end of a casing joint, gripping the casing joint by an interior thereof with the assembly responsive to longitudinal movement of one portion of the assembly with respect to another portion of the assembly, pumping drilling fluid through the assembly to cause the assembly to grip the interior of the casing joint responsive to hydraulic pressure of the drilling fluid, preventing drilling fluid from exiting the upper end of the casing joint, and rotating the casing joint.

Another embodiment comprises a method of driving casing, including engaging an uppermost casing joint of a casing string having a device with a cutting structure thereon at a lower end thereof substantially only on an interior of the uppermost casing joint, rotating the casing string by application of torque to the interior of the uppermost casing joint and applying weight to the casing string during rotation thereof.

DETAILED DESCRIPTION

The illustrations presented herein are not actual views of any particular drilling system, assembly, or device, but are merely idealized representations which are employed to describe embodiments of the present invention.

While embodiments of the present invention are described herein with respect to manipulation of, and drilling with, casing, it is also contemplated that an appropriately sized drive assembly may be used to engage, rotate, and apply weight for drilling with any suitable tubular goods having sufficient longitudinal compressive and torsional (shear) strength to withstand application of longitudinal force and torque for drilling. Accordingly, as used herein, the term "casing" means and includes not only convention casing joints but also liner joints, drill pipe joints, and drill collar joints. In addition, multiple-joint assemblies, termed "stands," of any and all of the foregoing tubular goods may be used with, and manipulated by, embodiments of the apparatus of the present invention.

As used herein, the terms "upper," "lower," "above," and "below," are used for the sake of clarity in a relative sense as an embodiment of the casing drive assembly is oriented during use to manipulate and drive a casing joint or string.

Figure 1A:
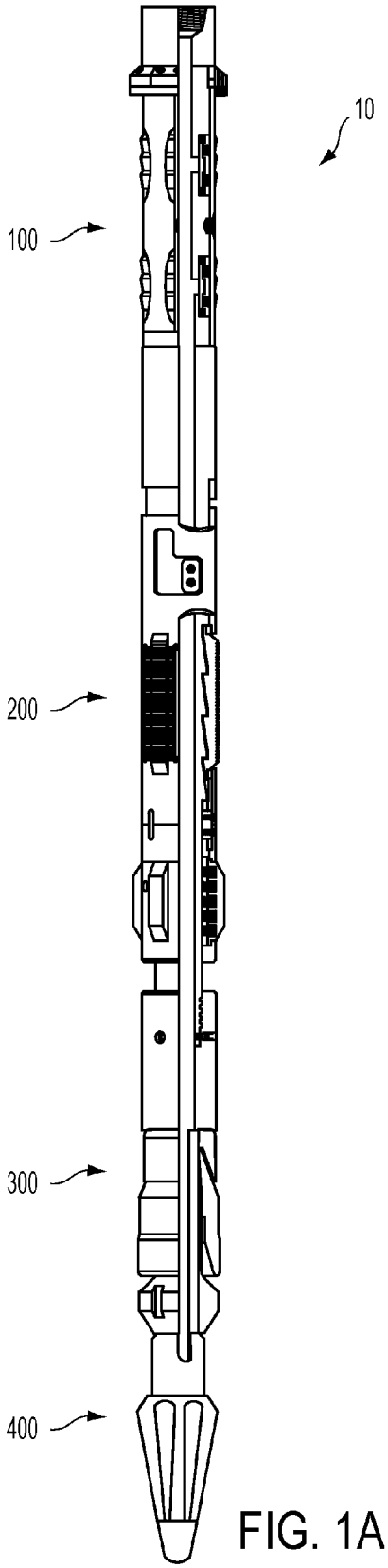
FIG. 1A is a partial sectional elevation of a casing drive assembly according to an embodiment of the present invention.

Referring to FIG. 1A of the drawings, an embodiment of a casing drive assembly 10 according to the present invention comprises, from an upper to a lower end thereof, a hydraulic anchor 100, a mechanical casing spear 200, a cup type packer 300, and a tapered stabilizer 400.

Figure 1B:
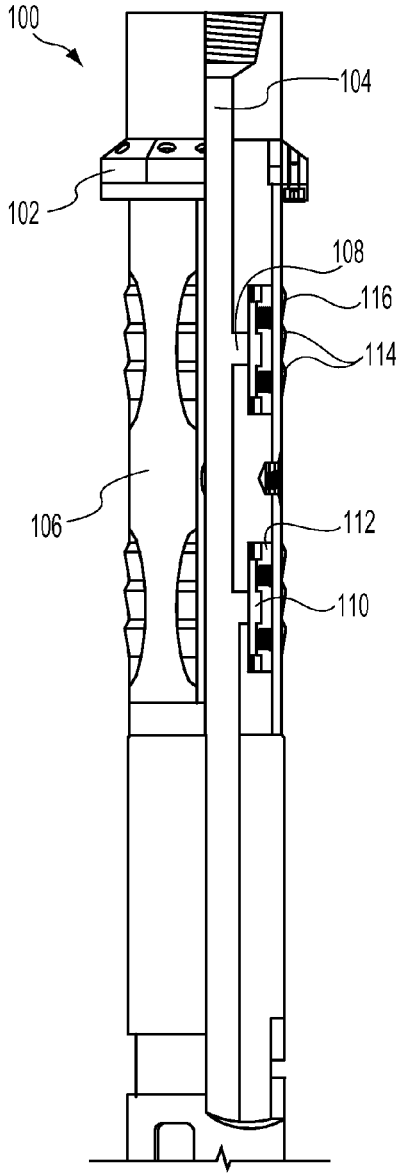
FIG. 1B is a detail view of FIG. 1A showing a hydraulic anchor of the casing drive assembly.

As shown in FIG. 1B, the hydraulic anchor 100 comprises a housing 102 having a circumferential stop collar 106 about the upper end thereof for limiting insertion of the casing drive assembly 10 into a casing joint. The housing 102 includes a longitudinal passage 104 extending therethrough from top to bottom, in communication with lateral passages 108 extending to the interiors of spring-loaded, inwardly biased pistons 110 in two longitudinally separated groups, each group comprising a plurality of pistons 110 (in this instance, four) equally circumferentially spaced in pockets 112 in the housing 102. Seals (not shown) enable fluid-tight movement of the pistons 110 in the pockets 112 responsive to a drilling fluid pressure within the longitudinal passage 104. The pistons 110 comprise gripping structures 114 on exterior surfaces 116 thereof, as is conventional in the art. Such gripping structures 114 may comprise, by way of non-limiting example, machined teeth, crushed tungsten carbide, tungsten carbide inserts in the form of bricks, buttons or discs, superabrasive elements such as natural or polycrystalline diamond, or a combination thereof. In one embodiment, gripping structures comprise carbide inserts configured with teeth.

Figure 1C:
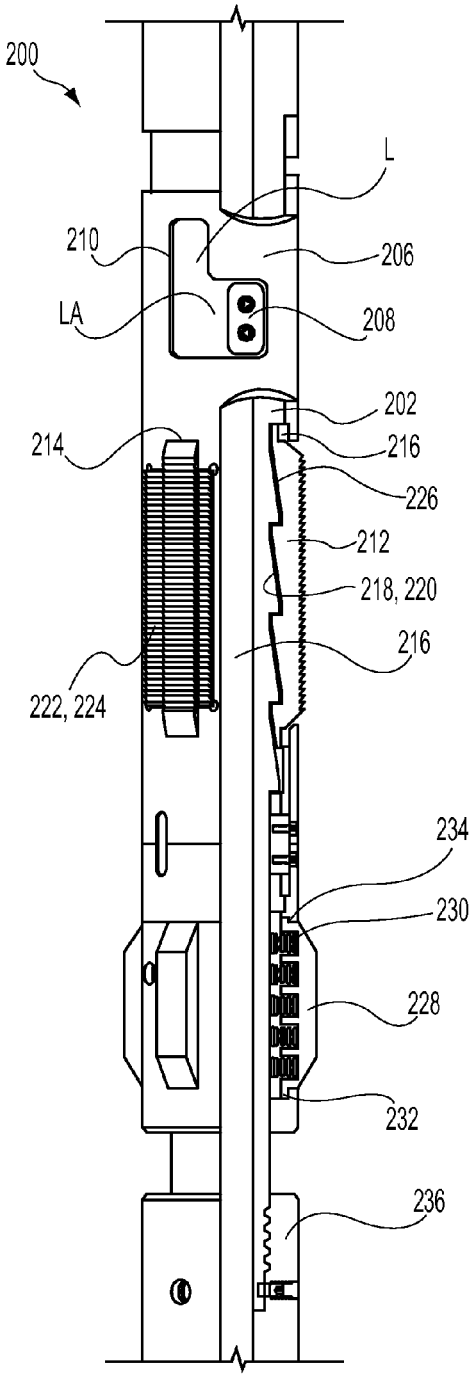
FIG. 1C is a detail view FIG. 1A showing a mechanical spacing spear of the casing drive assembly.

Secured to the lower end of the hydraulic anchor 100 is the casing spear 200, which may be configured substantially as a Baker Oil Tools (Tri-State) Type "D" Casing Spear. As shown in FIG. 1C, the casing spear 200 comprises a mandrel 202 having a longitudinal passage 204 extending therethrough and in communication with the longitudinal passage 104 of the hydraulic anchor 100. An outer housing 206 is longitudinally slidably and rotationally disposed over the mandrel 202, longitudinal movement of the outer housing 206 being constrained by engagement of a lug 208 protruding radially from the mandrel 202 through a J-slot 210 having a longitudinally extending segment L and a laterally extending segment LA, the lug 208 extending through the wall of outer housing 206. A plurality of slips 212 is disposed in a like plurality of slots 214 extending through the outer housing 206. The slips 212 include lips 216 at longitudinally upper and lower ends thereof to retain the slips 212 within the slots 214. The interior of the slips 212 comprise a plurality of stepped wedge elements 218 having concave, partial frustoconical radially inner surfaces 220. The outer surfaces 222 of the slips 212 comprise gripping structures 224, as is conventional in the art. Such gripping structures 224 may comprise, by way of non-limiting example, machined teeth, crushed tungsten carbide, tungsten carbide inserts in the form of bricks, buttons or discs, superabrasive elements such as natural or polycrystalline diamond, or a combination thereof. In one embodiment, gripping structures comprise tungsten carbide inserts in the form of buttons having four projecting, pyramidal points. Two longitudinally extending groups of eight to ten buttons per slip 212 may be employed.

Inner surfaces 220 of stepped wedge elements 218 are sized and configured to cooperate with stepped convex, frustoconical wedge surfaces 226 on an exterior surface of the mandrel 202 to move the slips 212 radially outwardly responsive to upward movement of the mandrel 202 within the outer housing 206. A plurality of circumferentially spaced stabilizer friction blocks 228 are radially outwardly biased by springs 230 and are disposed within slots 232 in outer housing 206 and retained therein against the outward spring biased by lips 234 at upper and lower ends of the stabilizer friction blocks 228. A lower housing 236 is secured to the lower end of the mandrel 202.

Figure 1D:
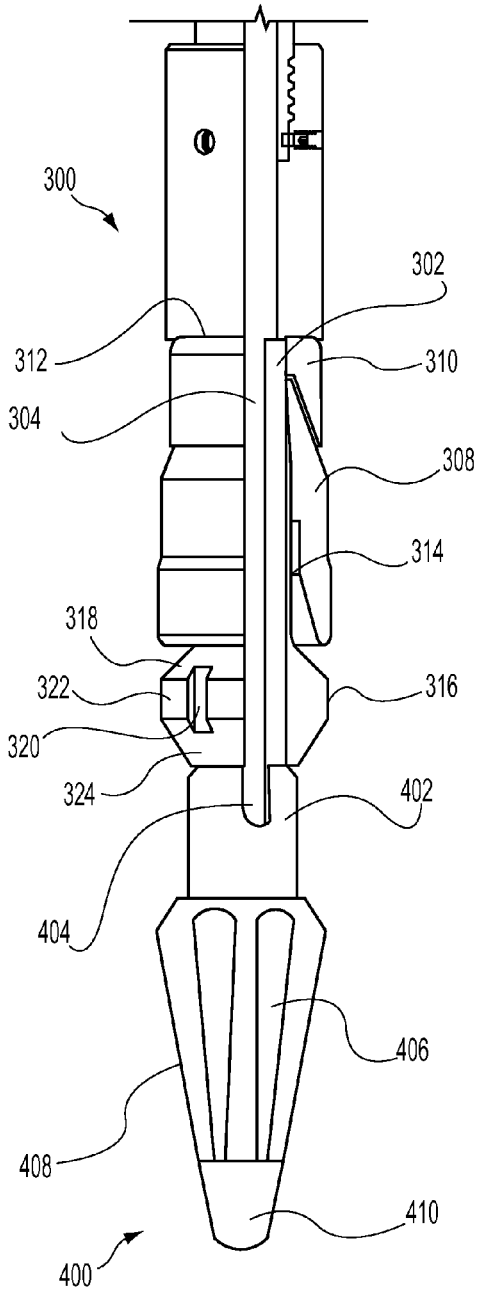
FIG. 1D is a detail view of FIG. 1A showing a cup type packer and a tapered stabilizer of the casing drive assembly.
Figure 2:
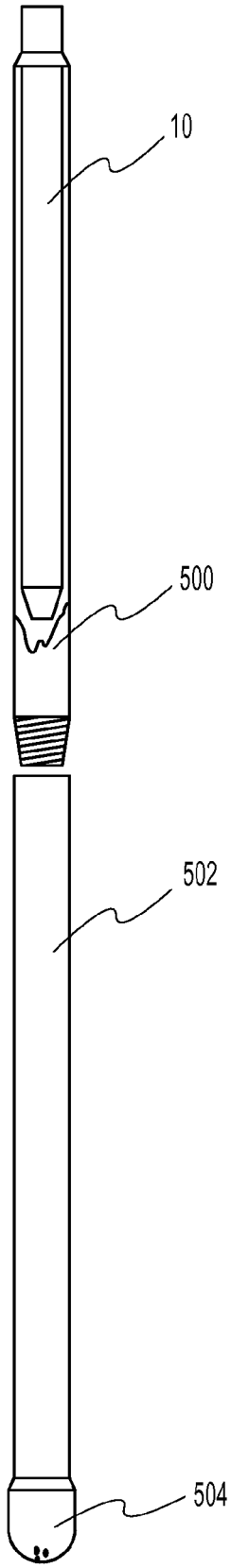
FIG. 2 is a schematic of a casing drive assembly, such as shown in FIG. 1A, disposed within a casing joint of a casing string above another casing joint.

Secured to the lower housing 236 of the casing spear 200 at the lower end thereof is a packer mandrel 302 of the cup-type packer 300, as shown in FIG. 1D, the cup-type packer 300 having a longitudinal passage 304 therethrough in communication with the longitudinal passage 204 of casing spear 200. A downward-facing, elastomeric, wire mesh-reinforced annular packer cup 308 is disposed over the upper mandrel 302 and retained thereon between an annular support wedge 310 abutting a downward-facing annular shoulder 312 and the upper end of a guide sleeve 314, from which an annular, radially projecting casing guide 316 projects. The casing guide 316 comprises frustoconical upper and lower surfaces 318, 320 longitudinally separated by a cylindrical guide surface 322, circumferentially spaced, longitudinally extending slots 324 communicating between the upper and lower surfaces 318, 320.

As further shown in FIG. 1D, the tapered stabilizer 400 is secured at its upper end 402 to the lower end of the packer mandrel 302, and includes a longitudinal passage 404 in communication with the longitudinal passage 304 of the cup-type packer 300. The longitudinal passage 404 extends to, and communicates with, outlet slots 406 extending through an outer surface of a frustoconical, tapered stabilizer guide 408 terminating at a nose 410.

In use, and with reference to drawing FIGS. 1A, 1B, 1C, 1D and 2, wherein a casing joint 500 is shown disposed above another casing joint 502, a single joint of casing 500 is picked up using the rig elevators, as is conventional, and stabbed up into an existing casing joint 502 (if a casing string has already been started). The casing drive assembly 10 is made up with and suspended from a top drive via a slack joint, and lowered by the top drive into the bore of the casing joint 500 from the top thereof. The elevators stay latched and ride down the casing joint 500 during this operation. Once the casing drive assembly 10 has entered casing joint 500 sufficiently so that stop collar 104 arrests further travel of casing drive assembly 10 into the casing joint 500, casing joint 500 is rotated to engage casing joint 502. The casing joint 500 may be run up with the rig tongs or casing drive assembly 10 may be used to transmit rotation to the casing joint 500 once it is fully engaged with casing joint 500, after engagement with the interior of casing joint 500, as described below. The tapered stabilizer guide 408, the casing guide 316 and the spring-biased friction blocks 228 aid insertion and centering of the casing drive assembly 10 into and within the casing joint.

If the casing joint 500 is the first joint in the casing string, a cutting structure, such as a drilling or reaming device, is made up with the lower end thereof prior to insertion of casing drive assembly 10. Non-limiting examples of such devices are, for drilling, the EZ Case™ casing bit and, for reaming, the EZ Ream™ shoe. Otherwise, such a device 504 is already secured to the distal end of the lowermost casing joint in the casing string. To initially engage the casing drive assembly 10 with the interior of casing joint 500, the casing spear 200 is manipulated, as by right-hand (clockwise, looking downward) rotation of the casing drive assembly 10 to move the lug 208 within the laterally extending segment LA of the J-slot 210 and align the lug 208 with the longitudinal segment L of the J-slot 210, followed by application of an upward force to the casing drive assembly 10. The spring-biased friction blocks 228 provide sufficient, initial frictional drag against the interior of the casing joint 500 to maintain the outer housing 206 of the casing spear 200 stationary within the casing joint 500 until the gripping structures 224 on the outer surfaces 222 of the slips 212 engage the interior of the casing joint 500 as the stepped convex, frustoconical wedges surfaces 226 of the mandrel 202 move upwardly with respect to the stepped wedge elements 218 on the interior surfaces 220 of the slips 212 and force the slips 212 radially outwardly to securely grip the interior of the casing joint.

The engaged casing joint 500 is then lifted using the top drive to permit slips of a holding device at the rig floor, commonly termed a "spider," which are employed to suspend the existing casing string below the rig floor, as is conventional.

The rig pump may then be engaged and circulation of drilling fluid established through the casing drive assembly 10 through the longitudinal passages 104, 204, 304 and 404 and out into the interior of the casing joint 500 through the outlet slots 406. Upward circulation of drilling fluid within the casing joint 500 is precluded by the packer cup 308, which expands against and seals with the interior of the casing joint 500 under drilling fluid pressure, a prompt and fluid-tight seal being facilitated by the presence of the slots 324 of the casing guide 316. Drilling fluid pressure is increased until sufficient pressure is observed to cause the pistons 110 of the hydraulic anchor 100 to grip the interior of the casing joint 500.

The casing drive assembly 10, with the casing joint 500 secured thereto by the hydraulic anchor pistons 110, is then rotated by the top drive to rotate the casing joint 500 and any others therebelow (if any) in the casing string, the top drive also providing weight, and drilling or reaming commences. Notably, both torque and weight are applied to the casing joint 500 via engagement of the casing drive assembly 10 substantially only with the interior of the casing joint 500.

The rig elevators remain attached as the casing joint 500 descends until a point just above the rig floor, where they can be reached and released for picking up the next casing joint. When the upper end of the casing joint 500, engaged by the casing drive assembly 10, approaches the rig floor, the slips of the spider are then employed to grip the casing joint 500, drilling fluid circulation ceases, releasing the pistons 110 of the hydraulic anchor 100 from the casing joint under their inward spring-loading, the casing drive assembly 10 is lowered sufficiently to release the slips 210 of the casing spear 200 from the casing joint and rotated slightly to the left (counterclockwise, looking downward) to maintain the release of the slips 212, and the casing drive assembly 10 is withdrawn from the casing joint 500 for subsequent insertion into another casing joint picked up by the rig elevators, the above-described process then being repeated.

A significant advantage of the use of a casing drive assembly according to an embodiment of the present invention is reduced casing thread wear, due to the lack of a threaded connection between the casing drive assembly and the casing joint engaged thereby.

While particular embodiments of the invention have been shown and described, numerous variations and alternate embodiments will occur to those skilled in the art. Accordingly, it is intended that the invention only be limited in terms of the appended claims and their legal equivalents.

What is claimed is:

1. A method of manipulating casing, the method comprising:

gripping the casing joint by an interior thereof with a spear actuated by relative movement of components of said spear, said spear having a passage extending through a mandrel;

positioning said gripped joint for connection to another joint to form a string with said spear;

pumping drilling fluid through said mandrel of said spear;

actuating an anchor mounted in fluid communication with said passage with said pumping through said mandrel, said anchor disposed on said mandrel in a spaced relation to said spear, to grip the casing joint for torque transmission to said casing joint;

internally sealing said string to direct said drilling fluid to a bit connected adjacent a lower end of said string; and rotating said gripped joint from a surface of a well with said anchor.

2. A method of manipulating casing, the method comprising:

gripping the casing joint by an interior thereof with a spear actuated by relative movement of components of said spear, said spear having a passage therethrough;

positioning said gripped joint for connection to another joint to form a string with said spear;

pumping drilling fluid through said string and said spear;

actuating an anchor mounted in fluid communication with said passage in said spear, with said pumping, to grip the casing joint for torque transmission to said casing joint;

internally sealing said string to direct said drilling fluid to a bit connected adjacent a lower end of said string; and rotating said gripped joint from a surface of a well with said anchor;

releasing said spear from said casing joint when said casing joint is retained by said anchor;

using as said bit a drilling device or a reaming device;

driving said string with a top drive.

3. The method of claim 1, wherein:

using a spear for said gripping that further comprises at least one drag block, a j-slot and at least one slip for said gripping.

4. The method of claim 3, further comprising using a two position j-slot with one position for holding said slip retracted and another enabling radial extension of said slip.

5. The method of claim 3, further comprising:

using a hydraulically actuated anchor for said rotating.

6. The method of claim 5, further comprising:

removing or inserting said spear and hydraulically actuated anchor when drilling fluid is not flowing.

7. The method of claim 1, wherein:

using a downward-facing packer cup to seal against said gripped joint.

8. The method of claim 1, further comprising:

locating a grip location in said gripped joint by using the top of the gripped joint as a reference location.

9. The method of claim 8, further comprising:

using a travel stop on a grip device to engage the top of said gripped joint for said locating.

10. A method of driving casing to drill an earth formation, comprising:

building a casing string by engaging an uppermost casing joint at a first location with a spear actuated by relative movement of components of said spear and connecting to another casing joint;

providing a device with a cutting structure thereon at a lower end of said string;

rotating with a top drive while applying weight to the casing string by application of torque to a second location of the interior of the uppermost casing joint using an anchor set with internal pressure in said string.

* * * * *